US005132869A

United States Patent [19]

Nakaya

[11] Patent Number: 5,132,869

[45] Date of Patent: Jul. 21, 1992

[54] CONTROL CIRCUITRY FOR AN IMAGE FORMING APPARATUS

[75] Inventor: Masahide Nakaya, Chigasaki, Japan

[73] Assignee: Ricoh Company, Ltd., Tokyo, Japan

[21] Appl. No.: 370,736

[22] Filed: Jun. 23, 1989

[30] Foreign Application Priority Data

Jun. 23, 1988 [JP] Japan ..... 63-153610

[51] Int. Cl.[5] ..... G03G 13/00

[52] U.S. Cl. ..... 361/233; 355/222; 355/296

[58] Field of Search ..... 355/203, 216, 207, 208, 355/219, 221, 222, 223-225, 296; 361/230, 225, 235, 229, 233; 363/59, 61; 250/324-326

[56] References Cited

U.S. PATENT DOCUMENTS

| | | | |
|---|---|---|---|
| 3,961,193 | 6/1976 | Hudson | 250/324 |
| 4,019,102 | 4/1977 | Wallot | 361/225 |
| 4,042,874 | 8/1977 | Quinn et al. | 361/225 |
| 4,166,690 | 9/1979 | Bacon et al. | 355/221 |
| 4,286,862 | 9/1981 | Akita et al. | 355/221 |
| 4,341,457 | 7/1982 | Nakahata et al. | 355/221 |
| 4,484,812 | 11/1984 | Takayanagi | 355/221 |
| 4,797,705 | 1/1989 | Nishioka | 355/207 |

*Primary Examiner*—A. D. Pellinen
*Assistant Examiner*—David Osborn
*Attorney, Agent, or Firm*—Oblon, Spivak, McClelland, Maier & Neustadt

[57] ABSTRACT

Improved circuitry applicable to an electrophotographic copier or similar image forming apparatus for controlling high voltages which are applied to various components of the apparatus such as corona dischargers. While the charge current of a photoconductive element is detected periodically, the output current of a high-tension power source which feeds a high voltage to a corona discharger is set on the basis of the detected charge current. When the charge current is set at a predetermined value, the output current of the high-tension power source is subjected to constant voltage control. Cleaning is performed only when the voltage is not at a reference value. A current feedback arrangement from the photoconductor uses two oppositely polarized half-wave rectifiers and a voltage doubler.

8 Claims, 21 Drawing Sheets

FIG. 13

| No | DETECTED SIGNAL | TRANSFORMER |
|---|---|---|
| 1 | $PTI_{AC}$ | PT |
| 2 | $PTI_{DC}$ | |
| 3 | $DI_{AC}$ | D |
| 4 | $DI_{DC}$ | |
| 5 | $PCI_{AC}$ | PC |
| 6 | $PCI_{DC}$ | |

FIG. 14

| No | DETECTED SIGNAL | TRANSFORMER |
|---|---|---|
| 1 | $PTV_{AC}$ | PT |
| 2 | $PTV_{DC}$ | |
| 3 | $DV_{AC}$ | D |
| 4 | $DV_{DC}$ | |
| 5 | $PCV_{AC}$ | PC |
| 6 | $PCV_{DC}$ | |

CONTROL CIRCUITRY FOR AN IMAGE FORMING APPARATUS

BACKGROUND OF THE INVENTION

The present invention relates to circuitry for controlling an electrophotographic image forming apparatus.

An electrophotographic copier, facsimile machine, laser printer or similar image forming apparatus implemented by electrophotography has high-tension power sources for applying high voltages to, for example, corona dischargers which charge the surface of a photoconductive element for forming an electrostatic latent image representative of an original document on the photoconductive element. It has been customary to maintain the output voltages of such power sources constant. This brings about a problem that, when toner particles and paper dust deposit on any of the corona dischargers, the charge current of the photoconductive element which is charged by the corona discharger is varied to degrade the image quality.

SUMMARY OF THE INVENTION

It is therefore an object of the present invention to provide control circuitry for an image forming apparatus which insures desirable image forming conditions over a long period of time.

It is another object of the present invention to provide a generally improved control arrangement for an image forming apparatus.

In accordance with the present invention, control circuitry for an image forming apparatus comprises charge current detecting means for detecting a charge current of a photoconductive element which is installed in the image forming apparatus, high voltage generating means for applying a high voltage to a corona discharger which is located to face the photoconductive element, output current setting means for periodically taking in detected signals from the charge current detecting means to set an output current of the high voltage generating means, and constant current control means for applying constant current control to an output current of the high voltage generating means which appears when the charge current of the photoconductive element is set at a predetermined value in response to an output of the charge current detecting means.

Also, in accordance with the present invention, control circuitry for an image forming apparatus comprises high voltage generating means for applying a high voltage to a corona discharger which is located to face a photoconductive element which is installed in the image forming apparatus, charge current detecting means having a resistor for detecting a charge current of the photoconductive element, the photoconductive element being connected to ground via the resistor, half-wave rectifying means assigned to a positive output for detecting a positive component, half-wave rectifying means assigned to a negative output for detecting a negative component, and voltage doubler rectifying means assigned to a positive output for detecting an AC component. The half-wave rectifying means assigned to a positive and a negative output, respectively, and voltage double rectifying means are connected in parallel to the resistor of the charge current detecting means.

Further, in accordance with the present invention, control circuitry for an image forming apparatus comprises charge current detecting means for detecting a charge current of a photoconductive element which is installed in the image forming apparatus, high voltage generating means for applying a high voltage to a corona discharger which is located to face the photoconductive element, output current setting means for periodically taking in detected signals from the charge current detecting means to set an output current of the high voltage generating means, and constant current control means for activating a cleaner associated with the corona discharger when an output voltage of the high voltage generating means exceeds a predetermined reference value. The constant current control means increases or decreases, when the output voltage of the high voltage generating means exceeds the reference value even after the activation of the cleaner, the output voltage of the high voltage generating means such that the output voltage becomes lower than the reference value. The constant current control means subjects the output current of the high voltage generating means to constant voltage control by using as a target value an output current of the high voltage generating means which appears when the output voltage becomes lower than the reference value.

BRIEF DESCRIPTION OF THE DRAWINGS

The above and other objects, features and advantages of the present invention will become more apparent from the following detailed description taken with the accompanying drawings in which:

FIGS. 13 and 14 each lists a relationship between output signals to be detected and transformers;

DESCRIPTION OF THE PREFERRED EMBODIMENT

Figure 1:
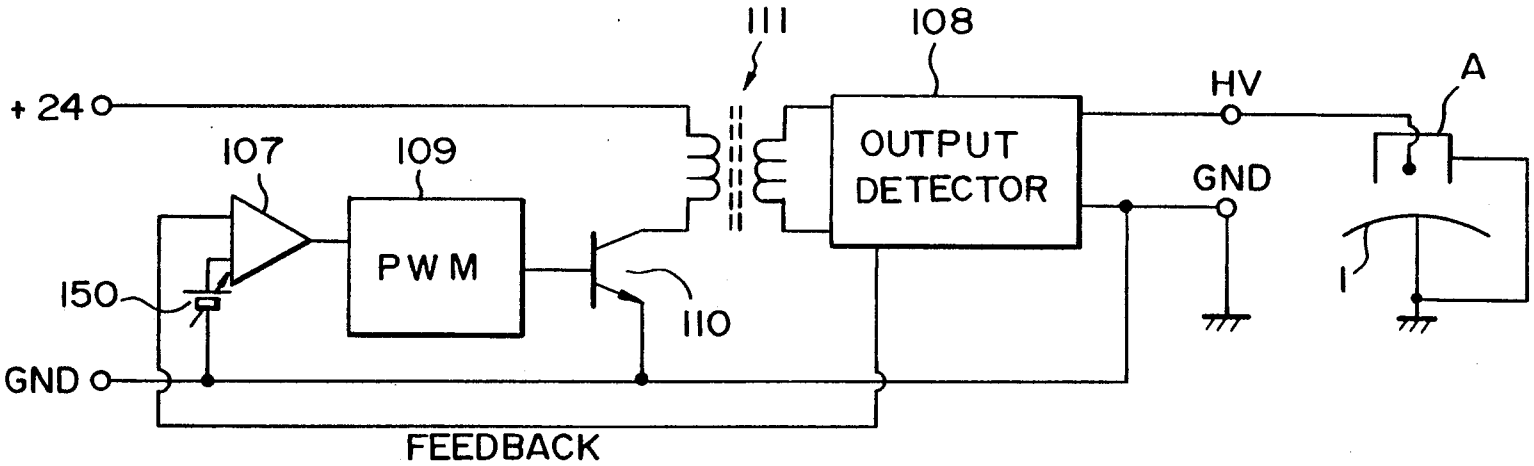
FIG. 1 PRIOR ART
FIG. 1 is a block diagram showing a prior art high voltage generating device.

To better understand the present invention, a brief reference will be made to a prior art high voltage generating device for an image forming apparatus, shown in FIG. 1. In the circuitry shown in FIG. 1, a variable resistor 150 and an output detector 108 deliver respectively a reference voltage and a feedback signal to a comparator 107. The comparator 107 feeds its output representative of a difference between the reference voltage and the feedback signal to a pulse width modulator (PWM) 109. The PWM 109 applies a pulse signal whose width is associated with the input to a transistor 110 for thereby driving a high-tension transformer 111. The transistor 110, therefore, performs switching with an ON/OFF duty which is associated with the voltage difference which is outputted by the comparator 107, whereby a high voltage is induced in the secondary winding of the high-tension transformer 111. The induced high voltage is applied to a corona discharger A so as to charge a photoconductive element 1. More specifically, a fixed voltage is constantly applied to the corona discharger A. A problem with such a prior art high voltage generating device is that, when toner particles and paper dust deposit on the corona discharger A, the charge current of the photoconductive element 1 fluctuates to effect the image quality, as stated earlier.

A preferred embodiment of the control circuitry for an image forming apparatus in accordance with the present invention will be described with reference to the accompanying drawings. In the figures, similar components and structural elements are designated by the same reference numerals, and redundant description will be avoided for simplicity.

Figure 2A:
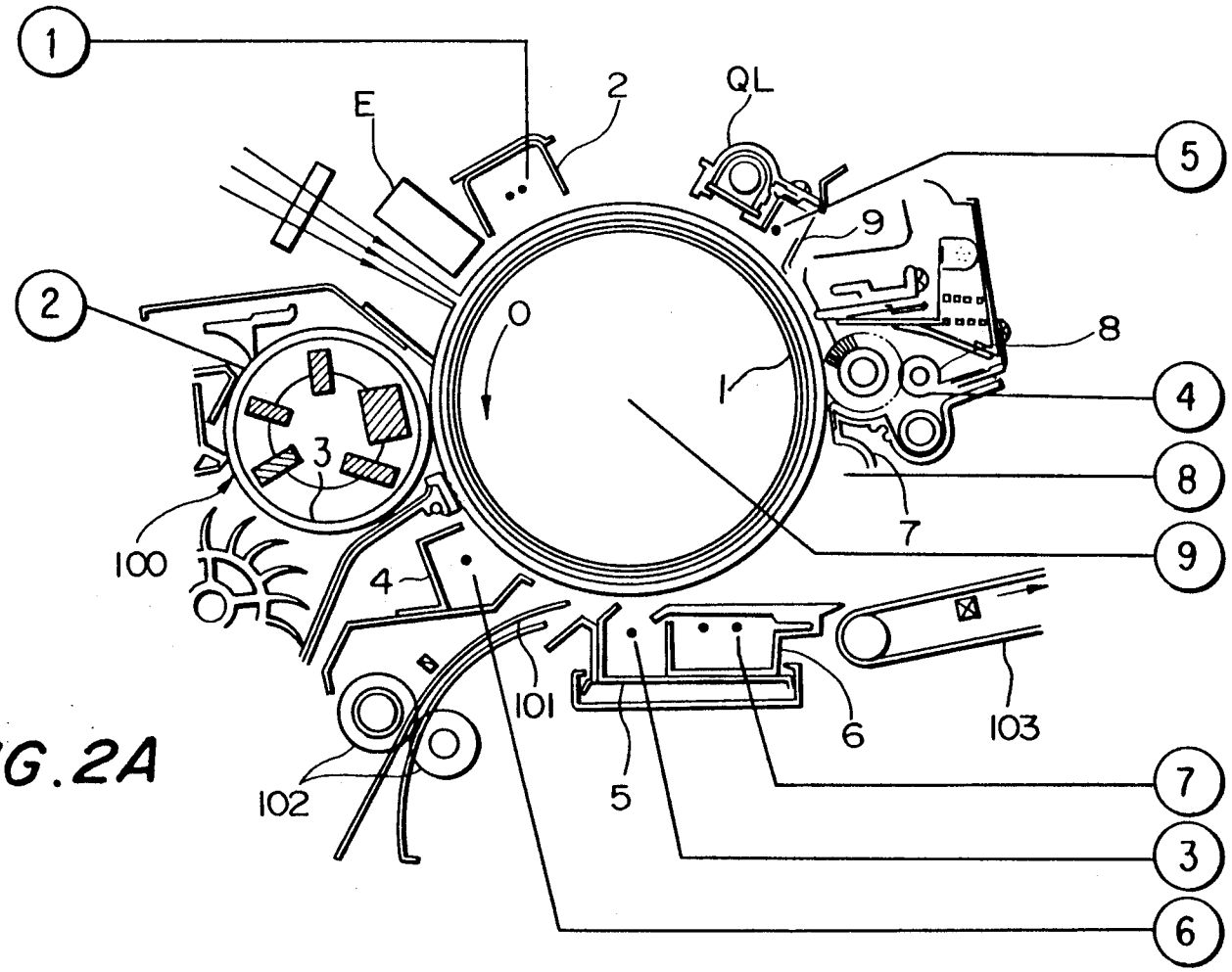
FIGS. 2A and 2B are views showing an image forming section and a high voltage generating device of an electrophotographic copier and representative of a preferred embodiment of the present invention.
Figure 2B:
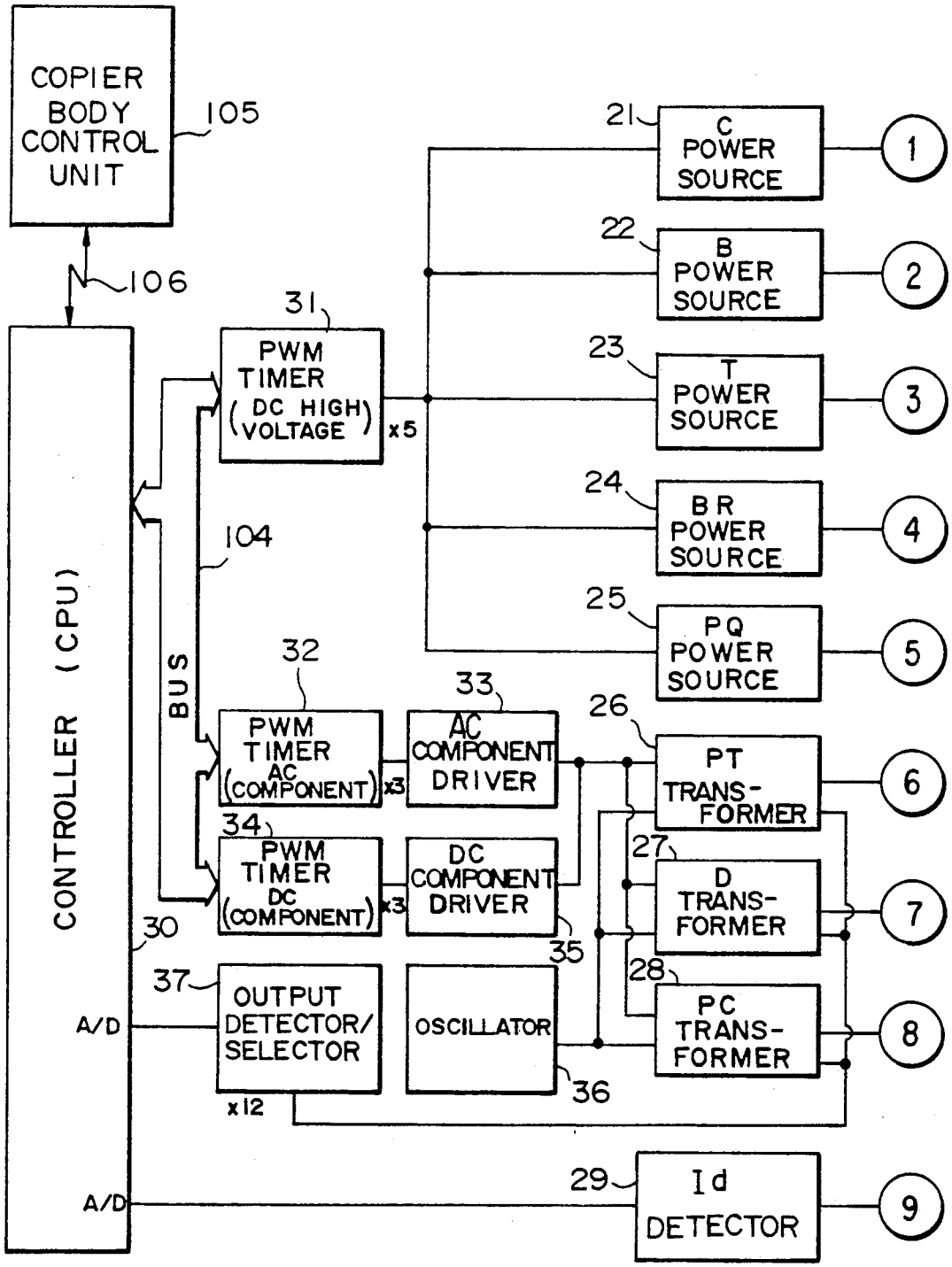

FIGS. 2A and 2B indicate respectively the general constructions of an image forming section of an electrophotographic copier to which the illustrative embodiment is applied and corona dischargers included therein, and a high voltage generating device associated with the corona dischargers and other various components of the image forming arrangement. As shown, the image forming section has a photoconductive element in the form of a drum 1 which is connected to ground via a charge current detector (hereinafter referred to as an Id detector) 29. The drum 1 is rotatable in a direction indicated by an arrow O in FIG. 2A. Arranged around the drum 1 are a charge corona discharger 2 connected to a charge high-tension power source (hereinafter referred to as a C power source) 21; a developing unit 100 having a developing sleeve 3 which is connected to a develop bias power source (hereinafter referred to as a B power source) 22; a pretransfer corona discharger (hereinafter referred to as a PT corona discharger) 4 connected to a PT discharge high-tension power source (hereinafter referred to as a PT transformer) 26; a transfer corona discharger 5 connected to a transfer high-tension power source (hereinafter referred to as a T power source) 23; a separate corona discharger 6 connected to a separate high-tension power source (hereinafter referred to as a D transformer); a precleaning corona discharger (hereinafter referred to as a PC corona discharger) 7 connected to a PC discharge high-tension power source (hereinafter referred to as a PC transformer) 28; a cleaning unit having a bias roller 8 which is connected to a clean bias power source (hereinafter referred to as a BR power source) 24; and a discharge corona discharger 9 connected to a discharge high-tension power source (hereinafter referred to as a PQ power source) 25. A guide plate 101 for guiding a paper sheet and a feed roller pair 102 are interposed between the PT corona discharger 4 and the transfer corona discharger 5. A transport unit 103 is located downstream of the separation corona discharger 6 for transporting a paper sheet carrying an image thereon to a fixing unit (not shown). Labeled E is an eraser.

In the above-described high voltage generating section, PWM timers 31, 32 and 34 are connected to a controller 30 by a bus line 104. The PWM timer 31 is connected to the power sources 21, 22, 23, 24 and 25 each of which generates a DC high voltage. The PWM timer 32 is connected to an AC component driver 33, while the PWM timer 34 is connected via a DC component driver 35 to the power sources 26, 27 and 28 each of which generates a DC-biased AC. Also connected to the AC power sources are an oscillator 36 for oscillating a common frequency of 500 Hz, and an output detector/selector 37 for detecting a high voltage output. The controller 30 is connected to a copier body control unit 105 which controls the entire copier operations, by a serial communication path 106 which is implemented by optical fibers.

The operations of the image forming section will be described.

COPYING PROCESS

In a copying process, the drum 1 the major component of which is selenium or the like is positively charged (about 800 V) by the corona discharge of the charge corona discharger 2. Then, the drum 1 is illuminated by imagewise light representative of an original document which is read by an image reader (not shown), whereby a latent image associated with the document is electrostatically formed on the drum 1. A toner carried on the developing sleeve 3 of the developing unit 100 is deposited on the drum 1 in association with the potential distribution on the drum 1, forming a toner image on the drum 1. The electrostatic adhesion of the toner and drum 1 is reduced by the AC corona discharge of the PT corona discharger 4, while a paper sheet (not shown) is fed by the feed roller 102 to lie on the toner image. Then, an electric field opposite in polarity to the charge of the toner (negative) is applied from the back of the paper sheet by the transfer corona discharger 5, so that the toner image is transferred to the paper sheet. The paper sheet has been electrostatically adhered to the drum 1 by an electric field which has been developed during the imagewise transfer. An AC electric field is applied to the back of the paper sheet by the separation corona discharger 6 so as to dissipate the charge of the paper sheet. As a result, the paper sheet is separated from the drum 1 by gravity and then transported to the fixing unit (not shown) by the transport mechanism 103. Paper dust and a small amount of toner remain on the drum 1 from which the paper sheet has been separated. An AC electric field is applied to the drum 1 by the PC corona discharger 7 to uniformize the potential on the drum 1, and then the remaining toner is removed from the drum 1 by a fur brush. The bias roller 8 removes the toner from the fur brush and collects it in a waste toner tank. After the drum 1 has been discharged by a DC electric field developed by the PC corona discharger 9, it is discharged by light issuing from a discharge lamp QL to regain the initial condition. This is the end of a sequence of image forming steps.

HIGH VOLTAGE GENERATING DEVICE

Figure 3:
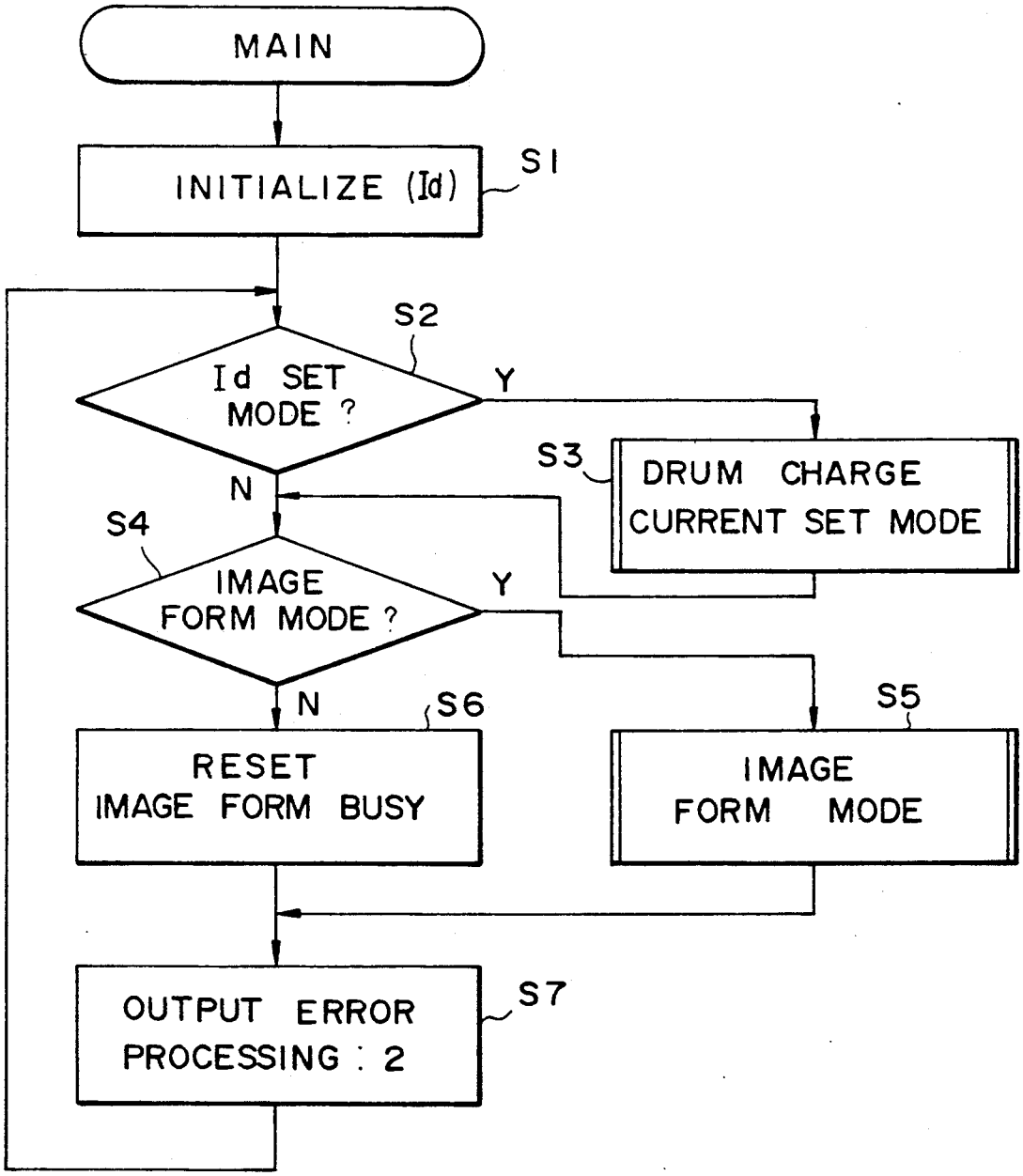
FIG. 3 is a flowchart demonstrating a main routine of the high voltage generating device.
Figure 4:
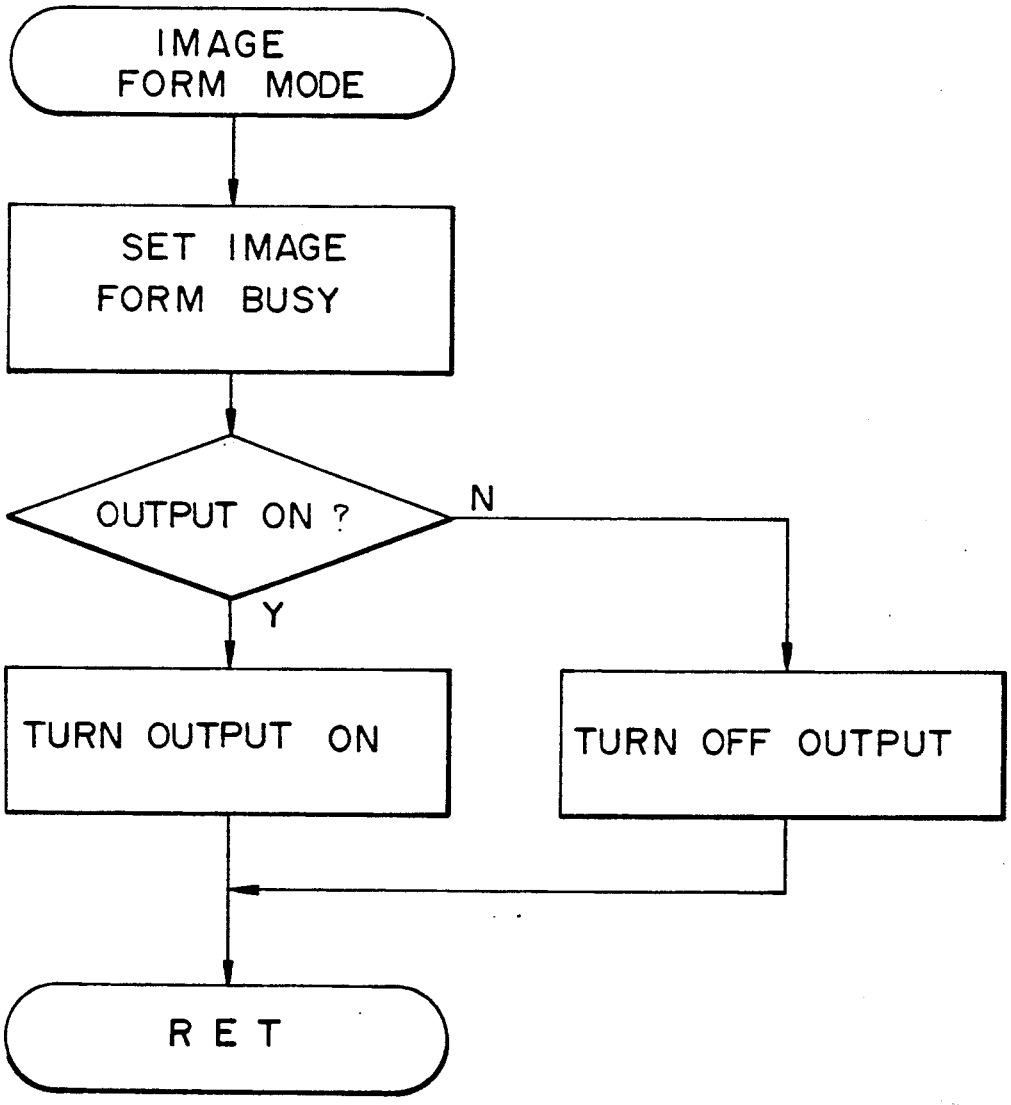
FIG. 4 is a flowchart indicating an IMAGE FORM MODE subroutine.

FIG. 3 indicates a main routine for controlling the high voltage generating section. When the power switch of the copier is turned on, the high voltage generating device is initialized (step S1). Specifically, in the step S1, the count of the PWM timer 31, the target values of constant current control and drum charge current set mode and other values are read out of a backup memory of the copier body control unit 105 and then loaded in the controller 30. At the same time, an FB interrupt timer is started which is loaded with timings for selecting and processing a signal which the control circuit 30 is to take in from the output detector 37. Hence, when triggers of the power sources and transformers are turned ON after the initialization, the associated high voltages are applied to the individual corona dischargers. After the initialization, a loop consisting of DRUM CHARGE CURRENT SET MODE (S2 and S3), IMAGE FORM MODE (S4, S5 and S6) and OUTPUT ERROR PROCESSING (S7) is executed, and these modes are individually set by an interrupt signal which is fed from the copier body control unit 105. Usually, after the mode consisting of the steps S2 and S3 has been executed on the turn-on of the power switch, the program awaits an IMAGE FORM MODE S4 command from the copier control body 105. In the OUTPUT ERROR PROCESSING S7, control is effected in association with the loads of the transformers 26, 27 and 28. FIG. 4 shows the IMAGE FORM MODE subroutine (S5) which involves setting the IMAGE FORM as busy followed by a checking of the output in order to provide a desired state. IMAGE FORM mode is commanded by an interruption, the subroutine of FIG. 4 is executed. The subroutine begins with a step of setting an IMAGE FORM BUSY flag to indicate that the IMAGE FORM mode is being executed. The output voltage of a high voltage generating section is selectively turned on or off in response to a signal which is fed from the copier body control unit 105. It is to be noted that the turn-on and turn-off of the output voltage is effected by the power sources 21 to 25 and the transformers 26 to 28 as shown from FIG. 2*b*.

POWER SOURCES AND TRANSFORMERS

Figure 5:
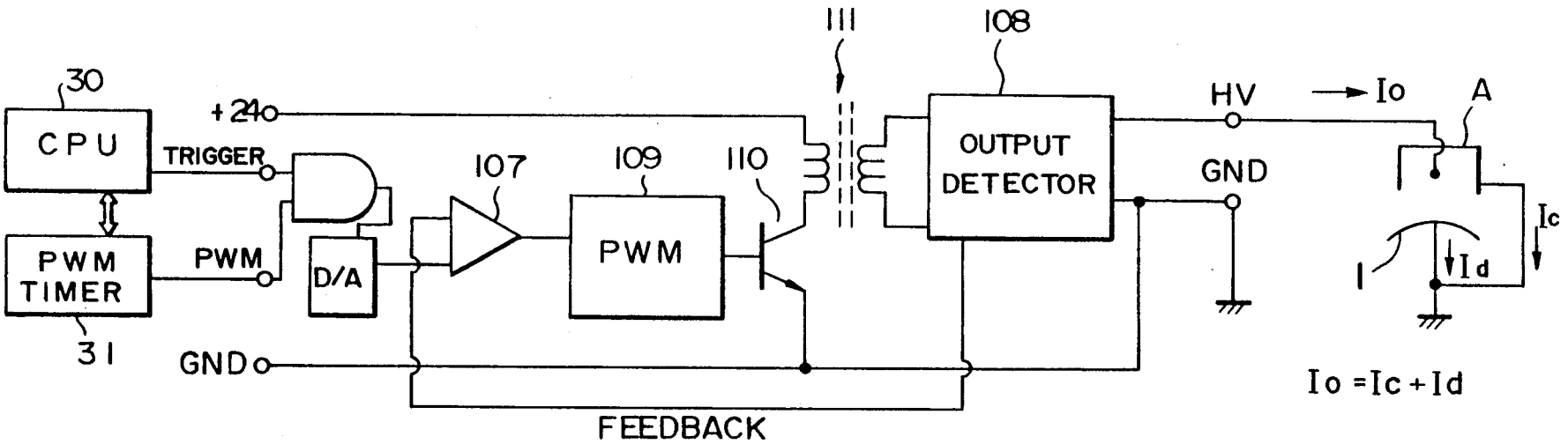
FIG. 5 is a block diagram showing one of a plurality of power sources included in the high voltage generating device.
Figure 6:
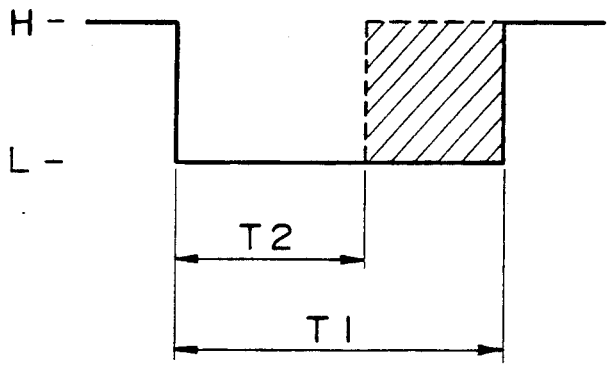
FIG. 6 is a diagram representative of a PWM signal which is generated by a PWM timer.
Figure 7:
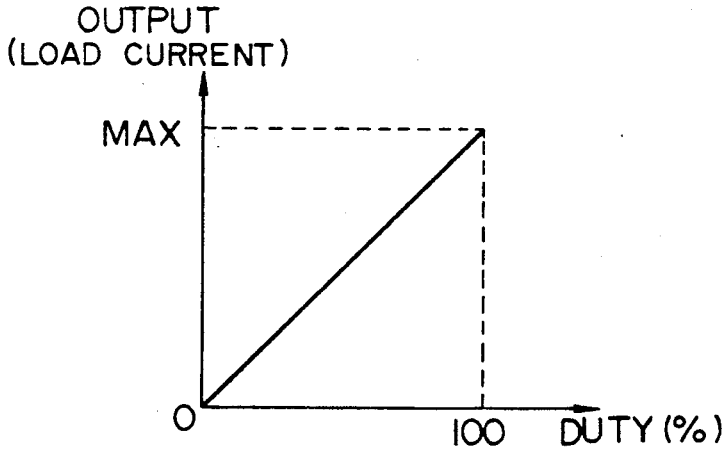
FIG. 7 plots a relationship between the output of a corona discharger (load current) and the duty of the PWM signal.

The C power source 21, T power source 23 and PQ power source 25 are high-tension power sources for generating DC voltages (about 6000 V) to effect corona discharge and have the same circuit construction. The output currents of the power sources 21, 23 and 25 are subjected to constant current control. FIG. 5 indicates a specific construction of any of the power sources 21, 23 and 25. As shown, the power source itself has a control function for stabilizing the output. In FIG. 5, the PWM timer 31 produces a PWM signal having a period of T1 (e.g. 1 kHz) and a time T2 of which is variable, as shown in FIG. 6. The power source transforms the PWM signal into an analog signal by an integrator (digital-to-analog (D/A) converter) which is built in the power source, the analog signal serving as the reference voltage for a comparator 107. The comparator 107 compares a feed back signal from an output detector 108 with the reference voltage and feeds the resulting voltage difference to a PWM 109 in the form of an error signal. The PWM 109 delivers a pulse signal whose width is associated with the error signal to a transistor 110, thereby driving a high-tension transformer 111. The transistor 110, therefore, performs switching with an ON/OFF duty which is associated with the error signal, whereby a high voltage is induced in the secondary winding of the transformer 111. The high voltage is converted into a DC voltage by a rectifier and then applied to a load (corona discharger A). The load current is detected as a voltage by the output detector 108 which is connected to the low voltage side of the transformer 111, while being fed back to the comparator 107. By such a feedback loop, the current flowing through the corona discharger A is controlled to a predetermined value. Hence, the load current is associated with the duty of the PWM signal of the PWM timer 31, as shown in FIG. 7.

Figure 8:
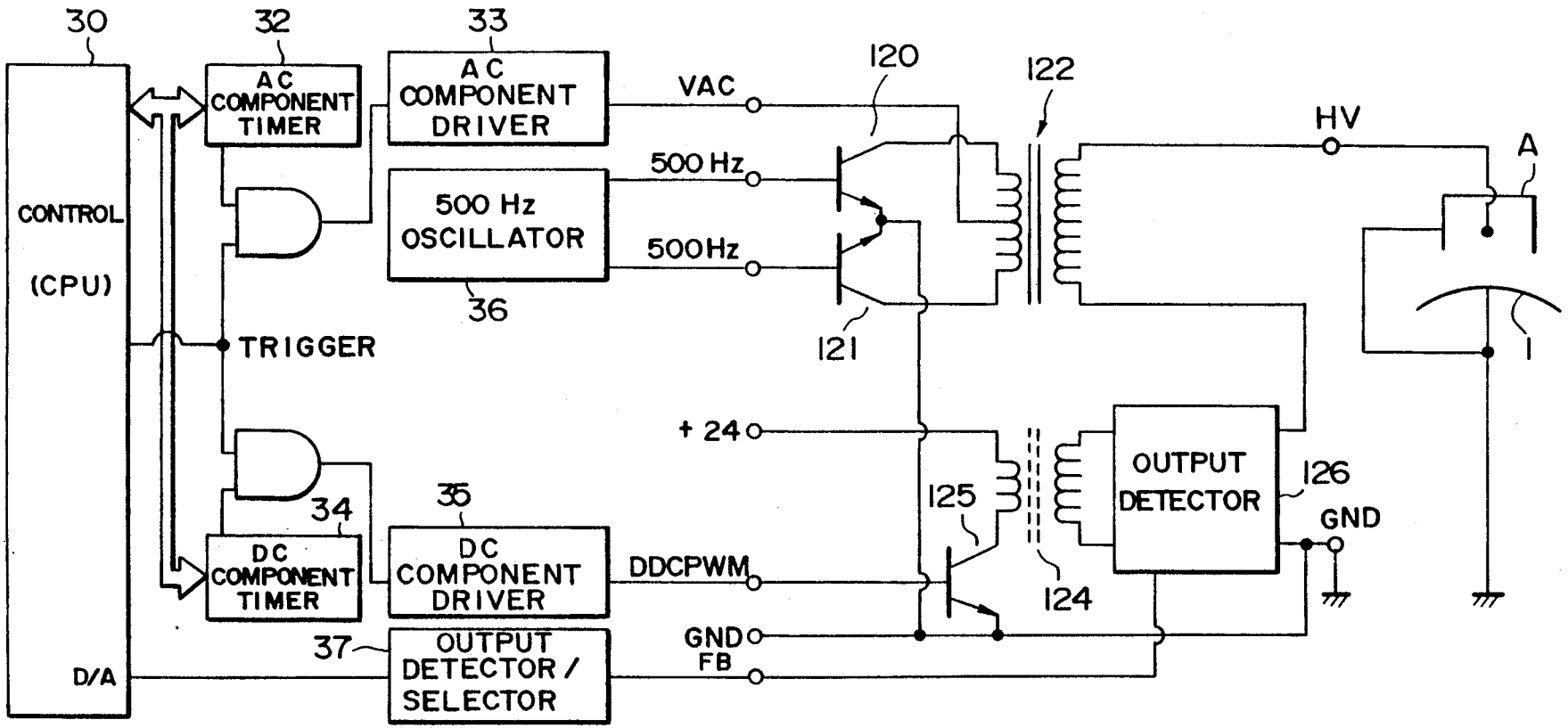
FIG. 8 is a block diagram showing a high-tension power source which generates a DC-biased AC.

The B power source 22 and BR power source 24 are bias power sources for outputting DC voltages (about 600 V) and the outputs of which are subjected to constant voltage control. The only difference of the power sources 22 and 24 from the power sources 21, 23 and 25 is that the output detecting means 108 detects the output voltage and controls it to a predetermined voltage. The PT transformer 26, D transformer 27 and PC transformer 28 each producing a DC-biased AC serve as high-tension power sources for producing DC-biased AC (500 Hz, 5500 Vrms) to effect corona discharge. The transformers 26, 27 and 28 have exactly the same construction, one of the transformers being shown in FIG. 8. In FIG. 8, the output of the transformer is stabilized by a controller 30.

CONTROL OVER TRANSFORMERS

Figure 9:
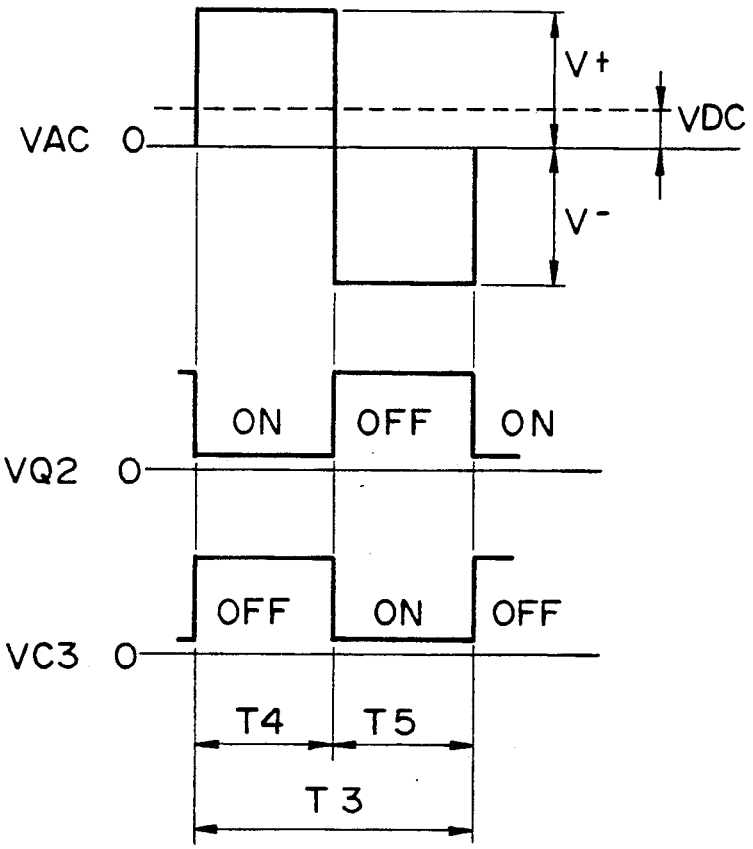
FIG. 9 is a timing chart showing voltages applied to a load (between HV and ground) of FIG. 8.
Figure 10:
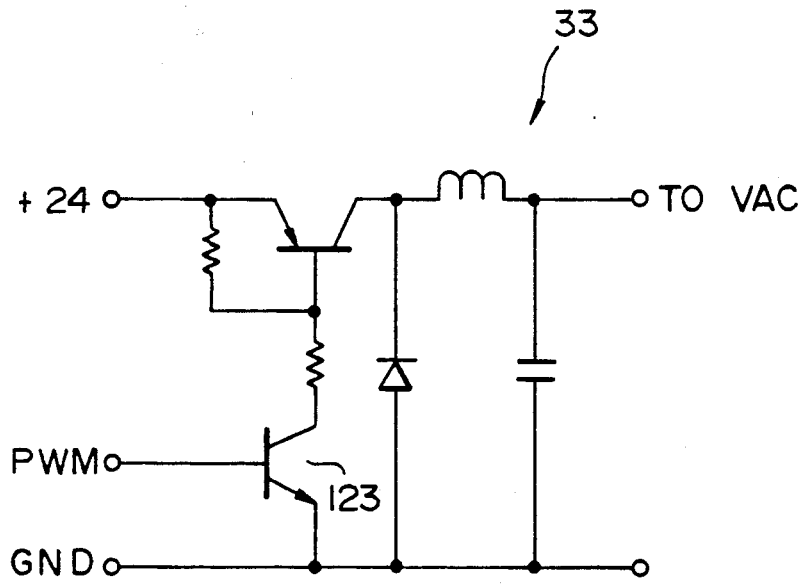
FIG. 10 is a circuit diagram showing an AC driver included in the power source of FIG. 8.

In detail, as regards the AC component, transistors 120 and 121 are turned on and off alternately by a pulse signal which is fed thereto from the oscillator 36, at a predetermined period (T3/2) as shown in FIG. 9. In this condition, AC high voltages having the same durations (T4 and T5) of positive and negative polarities and the same peak values (V+ and V−) are induced in the secondary winding of the high-tension transformer 122 in the form of a rectangular wave. The AC high voltages are proportional to the DC voltages which are fed from the AC component driver 33 to the transformer 122. As shown in FIG. 10, the driver 33 is implemented as a chopper type DC/DC converter. The output voltage of the driver 33 is associated with the duty of the PWM signal which is delivered from the PWM timer 32 to the base of a transistor 123. The PWM signal has a period of about 20 kHz (0.05 ms). The AC component of the high-tension output can be provided with a desired value by manipulating the duty of the PWM signal. The DC component is produced by applying the output voltage of a high-tension transformer 124 to between the high-tension transformer 122 and ground. Hence, a voltage having an AC component which has been biased by DC by VDC (V) as indicated by a phantom line in FIG. 9 is applied to the load (between HV and ground). To produce this DC component, the DC component driver 35 amplifies the PWM signal (0.05 ms) from the PWM timer 34 and feeds the amplified signal to the base of a transistor 125 so as to cause the transistor 125 to perform switching, and the resulting high voltage induced in the secondary winding of the transformer 124 is rectified. It follows that the DC component, like the AC component can be provided with any desired value by manipulating the duty of the PWM signal.

Figure 15:
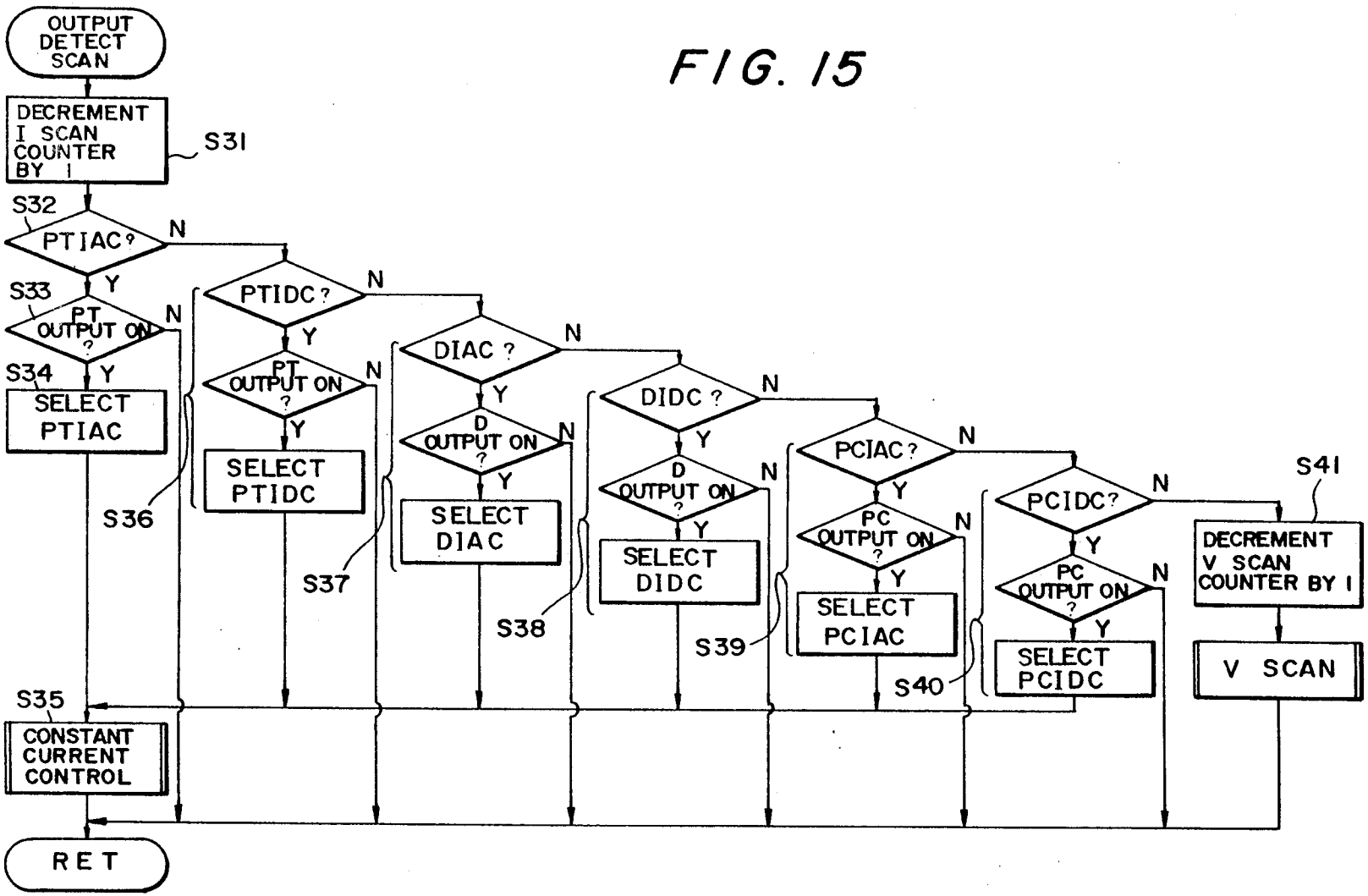
FIG. 15 is a flowchart demonstrating an OUTPUT DETECT SCAN procedure.

The outputs of the transformers 26, 27 and 28 are controlled by an OUTPUT DETECT SCAN subroutine shown in FIG. 15 and which will be described in detail later. Here, the control over the outputs of the individual transformers will be described. The output voltage and current are detected in the form of low voltages by output detecting means 126. The output detector/selector 37 selects the detected signals and feeds them to an A/D converter which is built in the controller 30. The output current is taken in at a predetermined period (e.g. 14 ms) and controlled to a constant value, according to a routine shown in FIG. 11. Specifically, the detected value taken in the controller 30 is transformed into digital data by the A/D converter to effect proportional control. In the proportional control, a difference between the detected data and a predetermined target value, i.e., error data is produced, the error data is multiplied by a predetermined proportional constant, the resulting product is added to the instantaneous counts (amounts of operation) of the PWM timers 32 and 34, and the PWM timers 32 and 34 are each updated with the resulting sum.

Figure 11:
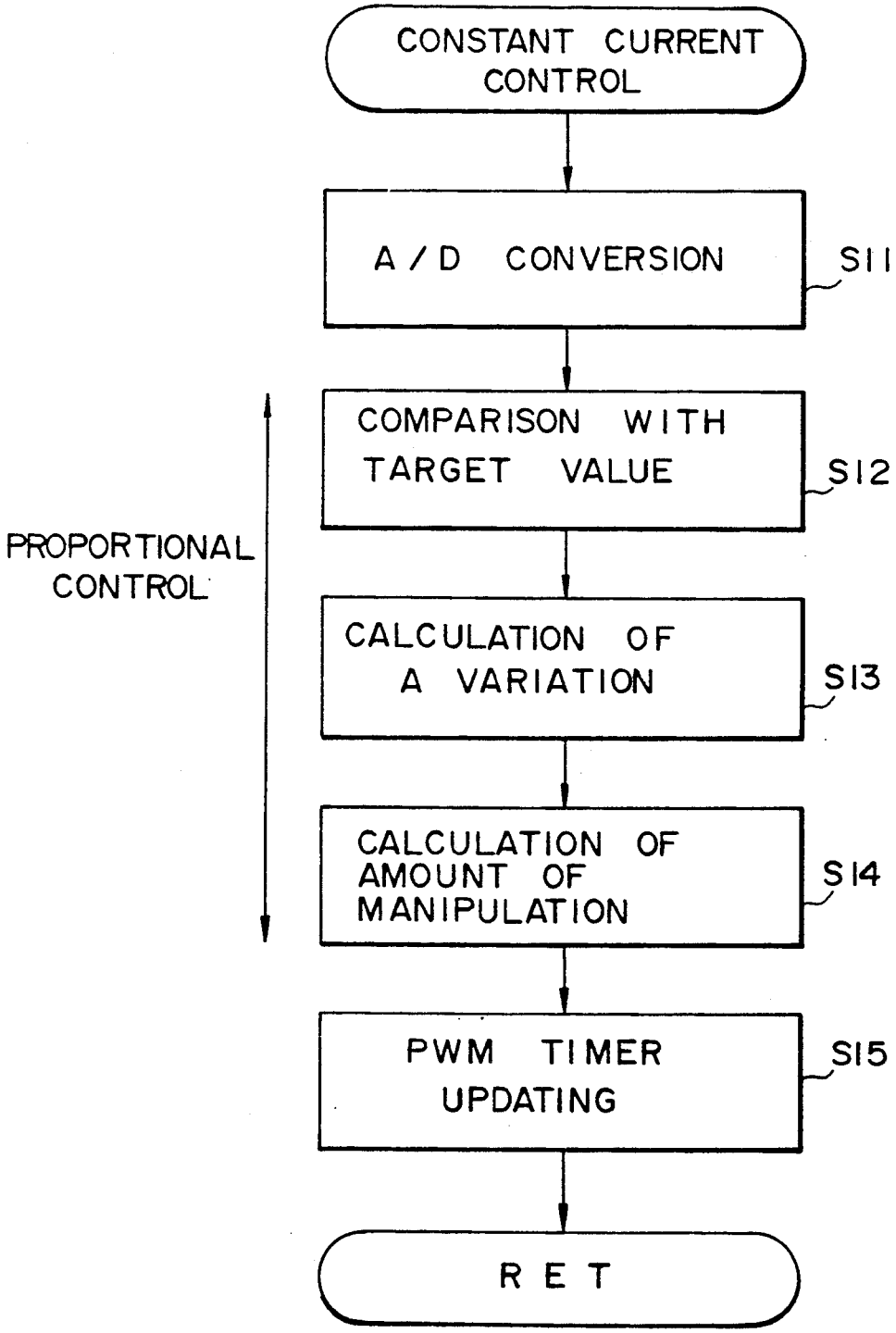
FIG. 11 is a flowchart demonstrating a CONSTANT CURRENT CONTROL procedure which is associated with a transformer.
Figure 12:
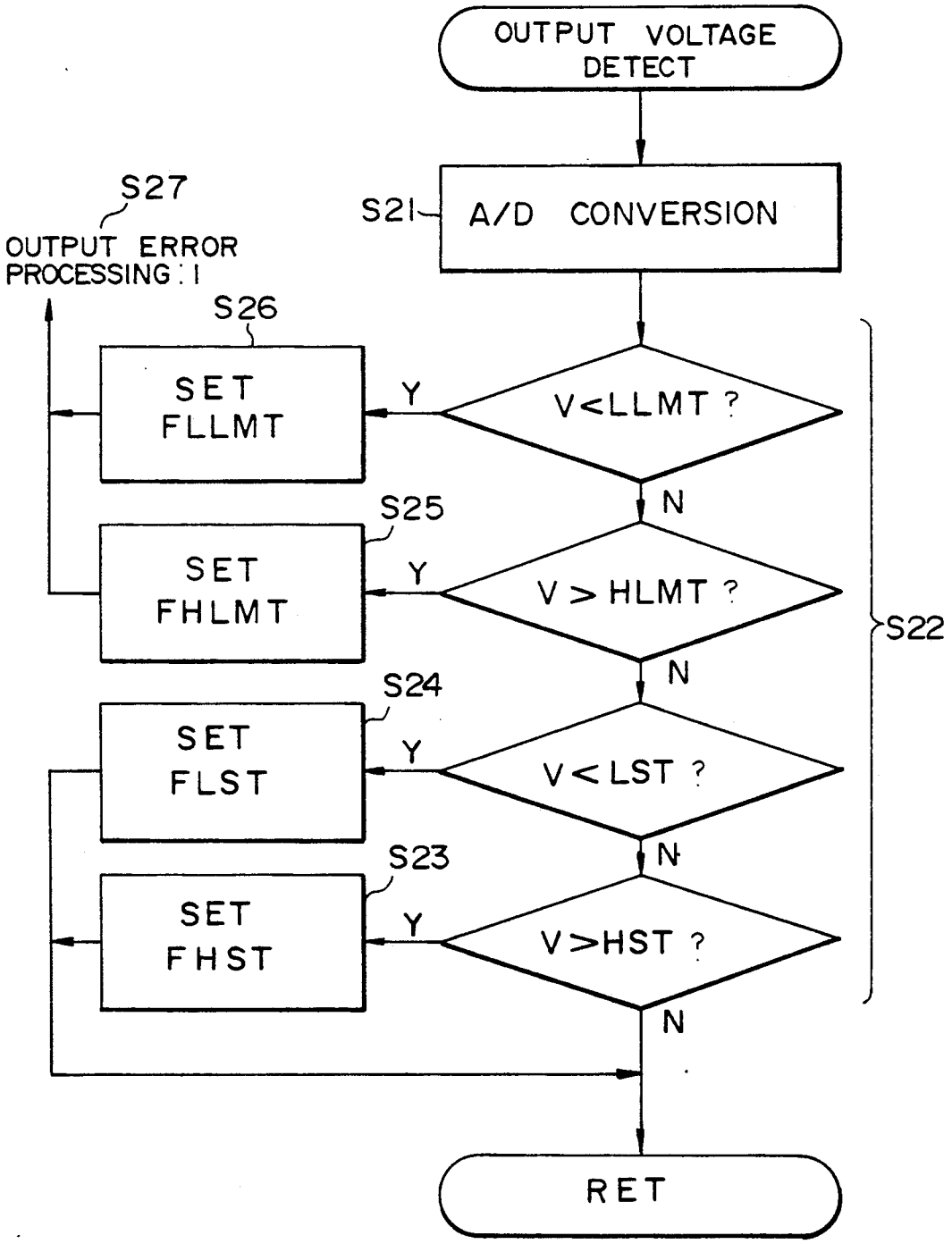
FIG. 12 is a flowchart demonstrating an OUTPUT VOLTAGE DETECT procedure also associated with a transformer.

The CONSTANT CURRENT CONTROL procedure shown in FIG. 11 begins with a step S11 for executing the A/D conversion as stated above. The result of A/D conversion is compared with the target value (S12), then the difference or error is produced (S13), then the amount of operation is calculated on the basis of the error (S14), and then the PWM timers 32 and 34 are updated. The output voltage is detected at a longer period (e.g. 100 ms) than the output current and processed by a procedure shown in FIG. 12. Generally, the procedure of FIG. 12 is such that the output voltage is compared with reference values to determine the condition of the load, and processing matching the result of comparison is executed. Specifically, after the signal representative of an output voltage has been converted into digital data (S21), whether or not the digital data lies in a predetermined range is determined (S22). In the illustrative embodiment, four different reference values are selected for each high-tension power supply, i.e., HLMT, HST, LST and LLMT as named from the highest voltage to the lowest voltage. When the detected data lies between HST and LST, the program ends the processing by determining that the output voltage is normal. When the detected data lies between HST and HLMT or between LST and LLMT, contamination of the corona discharger A is anticipated and, hence, the program sets an output error flag FHST (S23) or sets an output error flag FLST (S24) and ends the processing. Further, when the detected data is above HLMT or below LLMT, meaning that a critical error may have occured in the load, the program sets an output error flag FHLMT (S25) or sets an output error flag FLLMT (S26), interrupts the processing under way, and executes interrupt processing labeled OUTPUT ERROR:1 (S27).

A procedure for detecting the outputs of the individual transformers is as follows.

Since the control over the outputs of the transformers is collectively performed by the controller 30, detected signals are taken in and processed in a predetermined sequence. FIG. 13 shows output detected signals Nos. 1 to 6 which are detected and processed at a period of 14 ms, while FIG. 14 shows output detected signals Nos. 1 to 6 which are detected and processed at a period of 84 ms. As shown in FIG. 15, the OUTPUT DETECT SCAN subroutine is executed by FB interrupt which occurs every 2 ms in the controller 30. In this subroutine, two counters are implemented by a program, i.e. an I scan counter and a V scan counter. The I scan counter counts every time this subroutine is executed (2 ms), while the V scan counter counts every time the I scan counter counts up (14 ms). The counts of the I and V scan counters correspond one-to-one to the detected signals shown in FIGS. 13 and 14.

Figure 16:
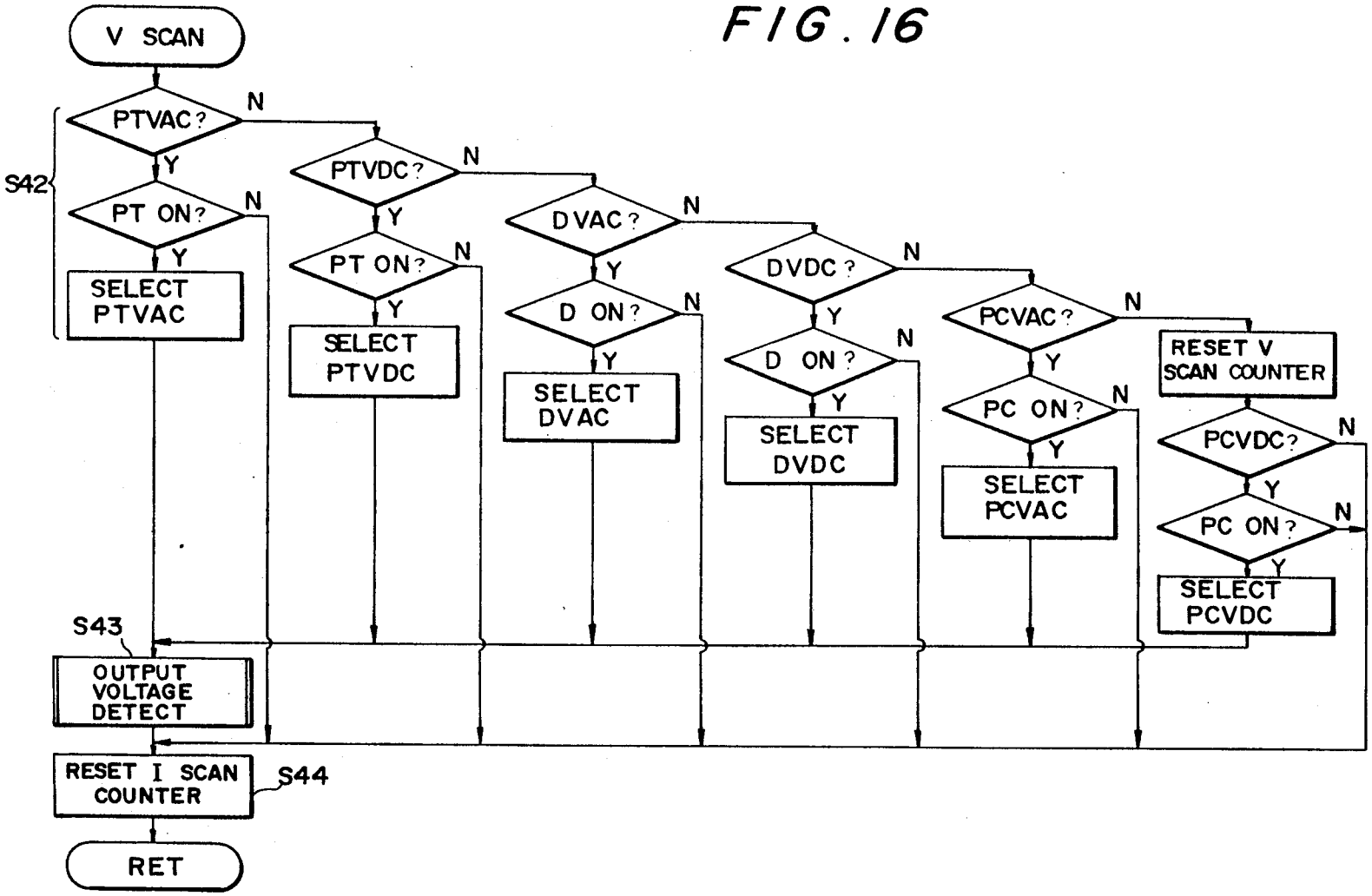
FIG. 16 is a flowchart indicating V SCAN control subroutine.

Specifically, the scan counter is decremented in response to an FB interrupt (S31) to select a particular detected value associated with the resulting count. First, as the AC component output current PTIAC of the transformer 26 is detected (S32), whether the output of the PT transformer 26 is ON (trigger ON) is determined (S33). If the answer of the step S33 is NO, the processing is ended; if it is YES, the output detected signal PTIAC is taken into the A/D converter of the controller 30 (S34). The step S34 is followed by the CONSTANT CURRENT CONTROL subroutine shown in FIG. 11 (S35), and then the processing is ended. In response to the next FB interrupt, PTIDC is detected (S36). Thereafter, the outputs DIAC (S37), DIDC (S38), PCIAC (S39) and PCIDC (S40) are detected one at a time in response to an FB interrupt. When a further FB interrupt occurs, the V scan counter is decremented (S41) and, then, the AC voltage PTVAC of the PT transformer 26 shown in FIG. 16 is detected (S42). This is followed by an OUTPUT DETECT subroutine (S43). Subsequently, the I scan counter is reset (S44) and, in response to an FB interrupt, the output PTIAC and successive outputs are detected in sequence. In this manner, every time the signal detection shown in FIG. 13 completes, the signals shown in FIG. 14 are detected one by one.

DETECTION OF DRUM CHARGE CURRENT

Figure 17:
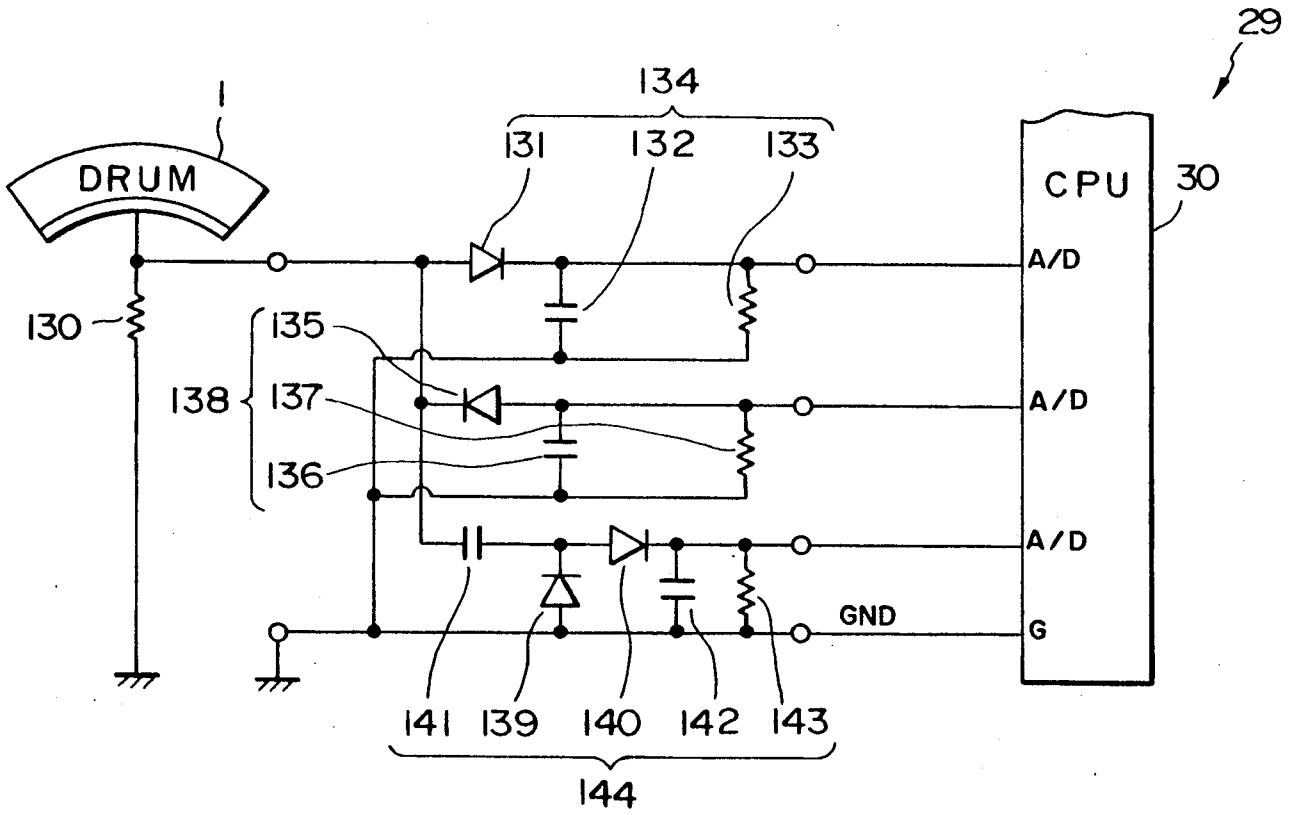
FIG. 17 is a circuit diagram representative of a circuit for detecting a charge current of a photoconductive element.

FIG. 17 indicates a specific construction of the Id detector 29. How the drum charge current Id produced by the corona discharge of any of the corona dischargers A is detected will be described with reference to FIG. 17. The drum 1 has conductive substrate which is connected to ground via a resistor 130 (e.g. 10 kΩ). Therefore, the drum charge current Id flowing through the drum 1 due to the discharge of the corona discharger appears as a voltage at opposite ends of the resistor 130. A positive component rectifier 134 for detecting a positive component of the current Id is constituted by a diode 131, a capacitor 132, and a resistor 133. A negative component rectifier 138 for detecting a negative component of the current Id is constituted by a diode 135, a capacitor 136, and a resistor 137. An AC rectifier 144 for detecting an AC component of the current Id is made up of diodes 139 and 140, capacitors 141 and 142, and a resistor 143. The rectifiers 134, 138 and 144 are connected in parallel to the resistor 130. The outputs of the rectifiers 134, 138 and 144 are connected to the A/D converter of the controller 30 independently of each other. With this construction, it is possible to detect DC and AC currents Id of positive and negative polarities at the same time and to detect a DC component (difference between positive and negative) included in AC by producing the sum of the positive and negative detected values. In a drum charge current set mode, one of these three kinds of detected signals applied to the A/D converter of the controller 30 is selected depending upon the corona discharger A of interest.

DRUM CHARGE CURRENT SET MODE

In this mode, the drum charge current Id is in effect controlled to a predetermined value by controlling a high-tension output which appears when the current Id is set at a predetermined value to a predetermined value. Specifically, while each corona discharger A performs corona discharge independently of the others, the value of the PWM timer or the target value for proportional control is varied. An output current appearing when the value detected by the Id detector 29 coincides with a predetermined value (predetermined drum charge current) is memorized, and the constant current control is effected by using the memorized current as a target value. As shown in FIG. 5, while an output current Io is divided into the drum charge current Id and a casing current Ic within the corona discharger A, the ratio of the current Id to the current Io (distribution ratio $=100*Id/Io$) usually changes due to toner particles and paper dust in the corona discharger A only. It follows that if the target value of output current Io is set at a certain period which accommodates the change in the above-mentioned ratio due to contanminants (e.g. on the turn-on of the power switch or once a day), a constant current can be achieved without actually detecting the drum charge current Id. In the drum charge current set mode, the power sources 21, 23 and 25 each sets the current Id by directly manipulating the count of the PWM timer 31, while the transformers 26, 27 and 28 each manipulators the target value for proportional control.

Figure 18:
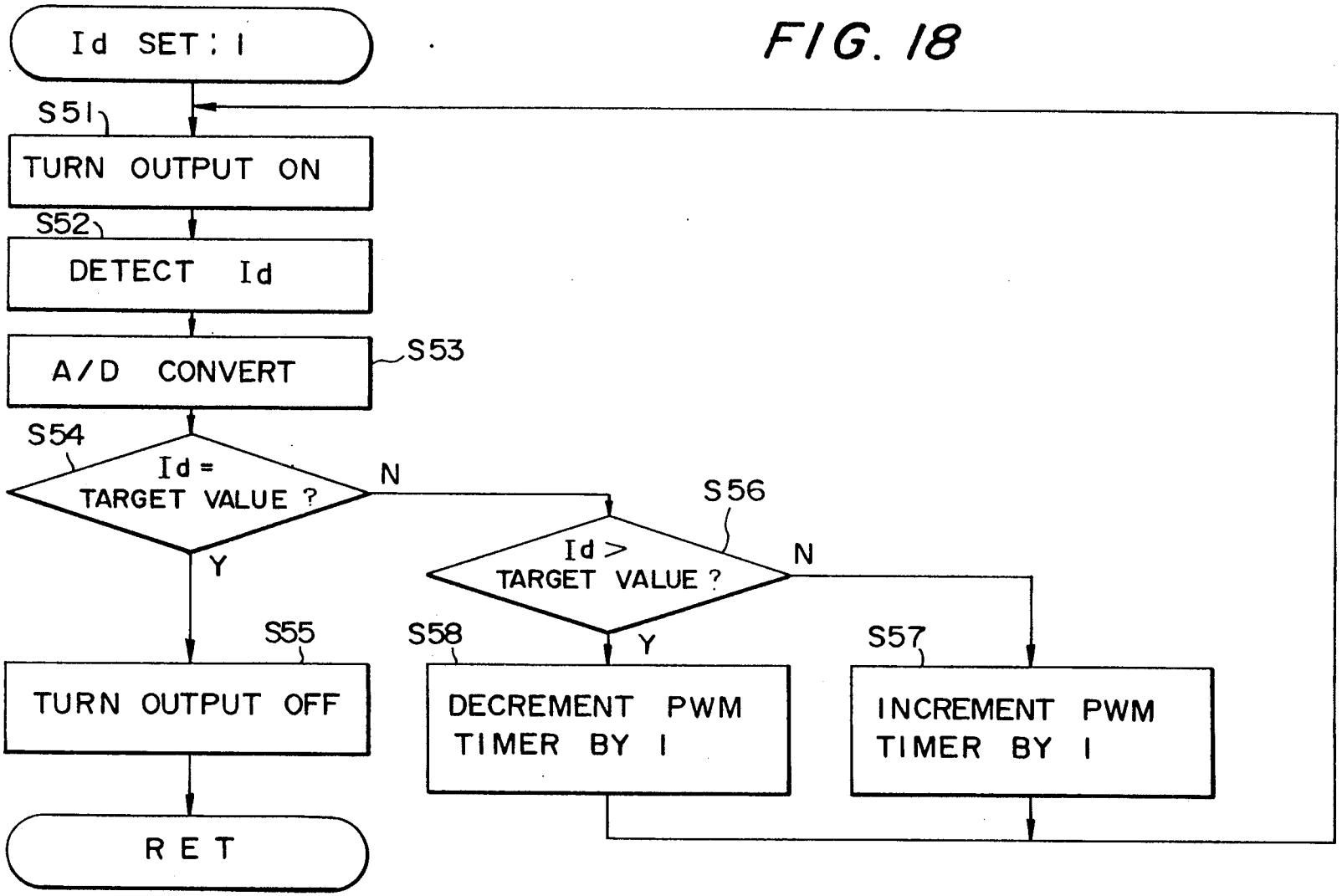
FIG. 18 is a flowchart demonstrating a DRUM CHARGE CURRENT SET:1 subroutine.

FIG. 18 shows an Id SET:1 subroutine associated with the power sources 21, 23 and 25. The subroutine begins with a step S51 for turning ON the output of the power source (trigger ON). At this time, the output current is based on the count of the PWM timer 31 which is currently set or, in an initial stage, on a PWM signal whose duty is associated with a predetermined standard count. On the lapse of a waiting time of several hundreds ms, the Id detector 29 detects the drum charge current Id (S52), the detected signal is converted into digital data (S53), and whether or not the detected data is coincident with a predetermined target value is determined (S54). If the answer of the step S54 is YES, the program ends the processing (S55); if it is NO, whether the current Id is smaller or greater than the target value is determined (S56), the PWM timer 31 is incremented or decremented (S57 and S58), the resulting count of the PWM timer 31 is loaded in the PWM timer 32, and the above procedure is repeated until the actual data coincides with the target value.

Figure 19:
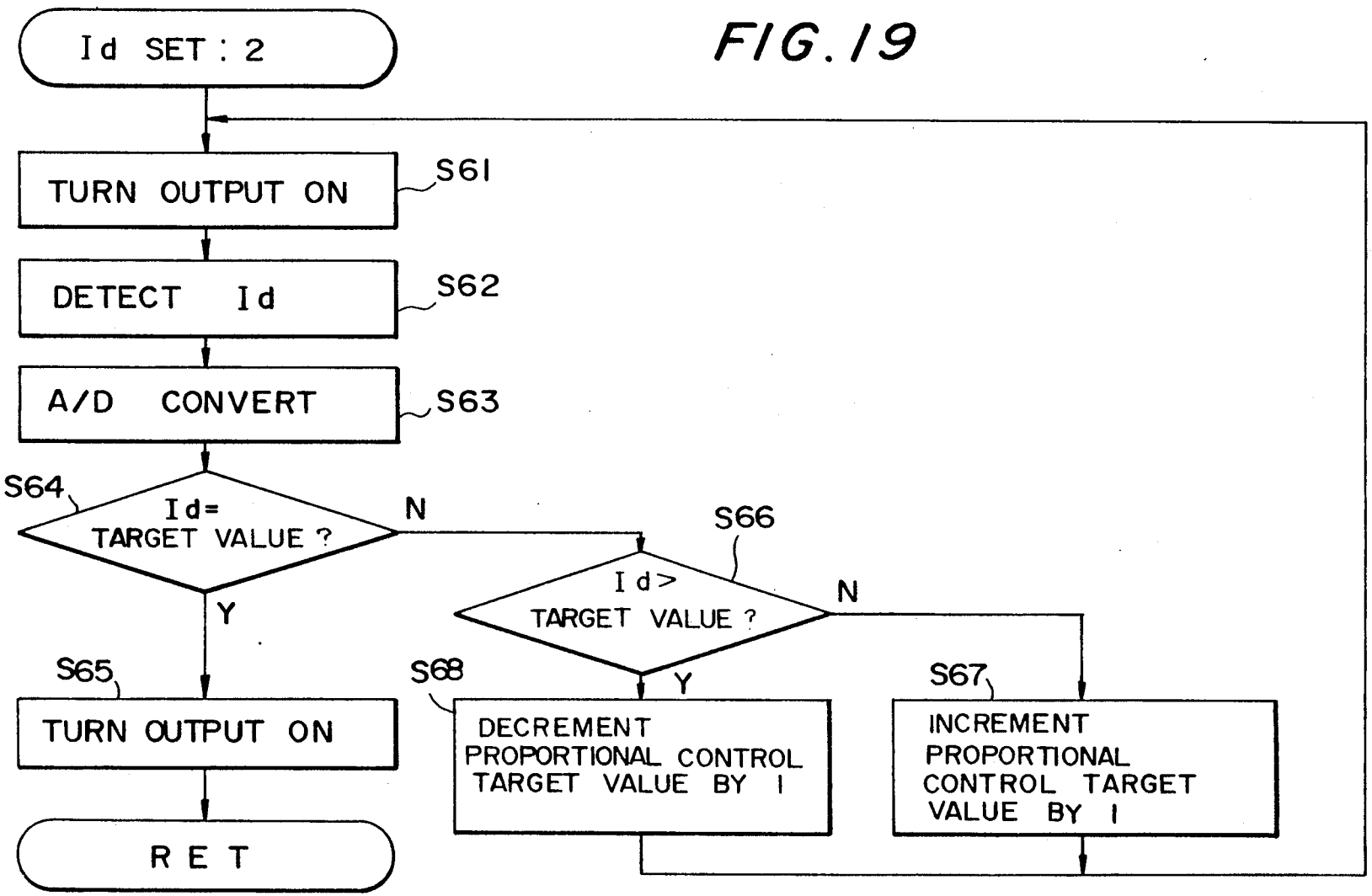
FIG. 19 is a flowchart showing a DRUM CHARGE CURRENT SET:2 subroutine.

FIG. 19 shows an ID SET:2 subroutine associated with the transformers 26, 27 and 28. As shown, the output is turned ON (S61) to execute the subroutine of FIG. 11 a plurality of times (e.g. five times). After the high-tension output has been sufficiently raised, Id detect processing (S62), A/D conversion (S63) and data decision (S64) are executed in sequence. If the answer of the step S64 is YES, the output is turned OFF (S65) and the procedure is ended. If it is NO, the relationship between the actual current Id and the target value for proportional control is determined by the CONSTANT CURRENT CONTROL subroutine (S66). Then, the current target value is incremented or decremented (S67 or S68). Such a procedure is repeated until the detected data coincides with the target value of the current Id.

Figure 20:
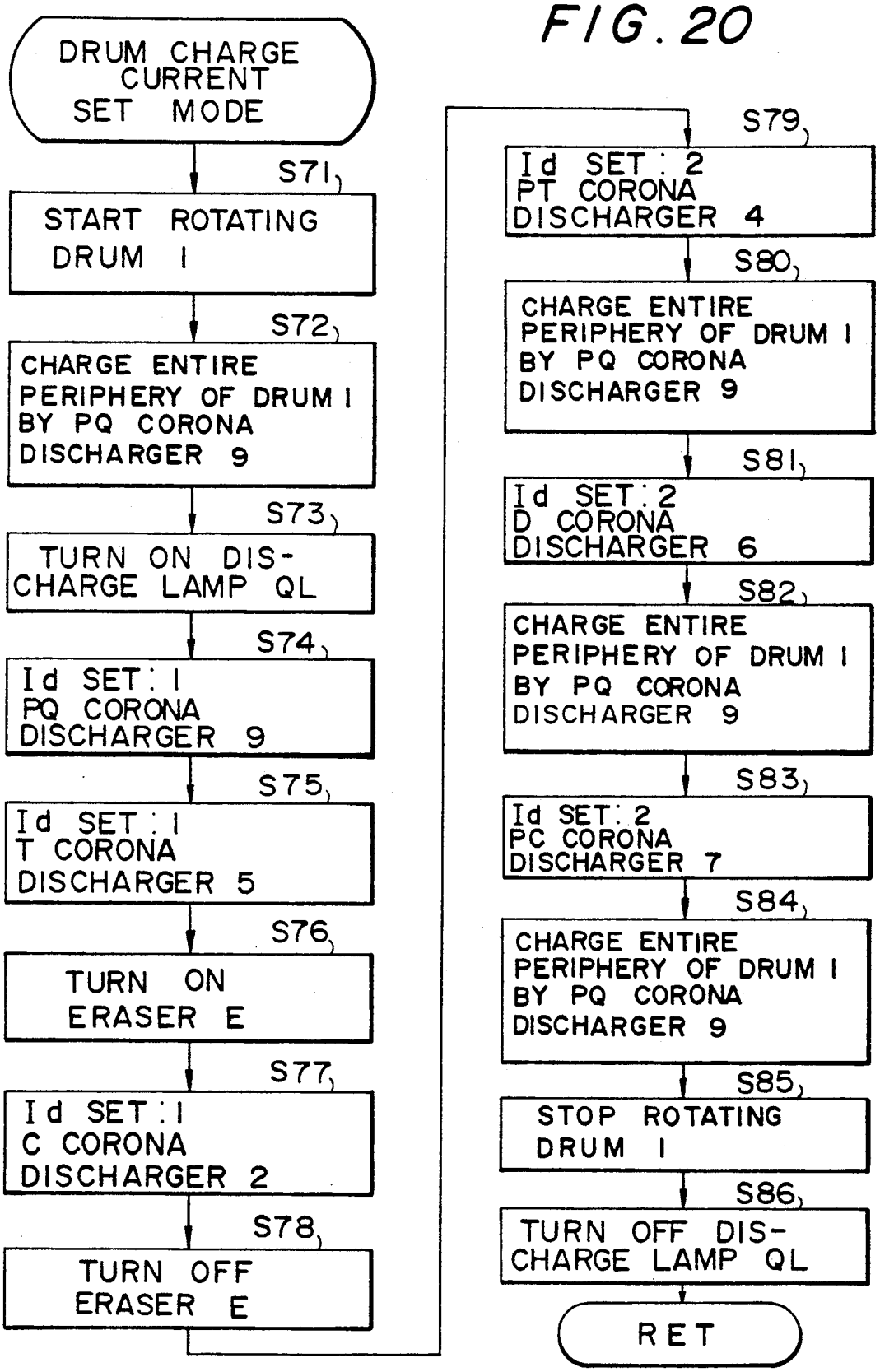
FIG. 20 is a flowchart showing a DRUM CHARGE CURRENT SET MODE subroutine.

FIG. 20 shows the DRUM CHARGE CURRENT SET MODE (S3) subroutine which is included in the main routine of FIG. 3. First, the drum 1 is rotated (S71). Then, the PQ corona discharger 9 is caused to discharge by an output current associated with a count which is loaded in the PWM timer 31 beforehand; the discharge is stopped after the entire periphery of the drum 1 has been charged (S72). At the same time, the discharge lamp QL is turned on to discharge the drum 1 (S73) and is continuously turned on until this mode ends. This is followed by the Id SET:1 subroutine for setting a positive drum charge current Id which is to be provided by the corona discharge of the PQ corona discharger 9 (S74). This subroutine is also executed with the T corona discharger 5 and C corona discharger 2 (S75 and S77). When the processing with the C corona discharger 2 is to be executed, the eraser E is turned on (S76). Then, the eraser E is turned off (S78). Subsequently, set processing is executed with each of the corona dischargers A which are performing DC-biased AC corona discharge. Specifically, the AC component of the PT corona discharger 4 is set according to the Id SET:2 subroutine shown in FIG. 19, whereafter the DC component of the same is set according to the same subroutine (S79). Concerning the DC component, a difference between the positive and negative polarities is compared with the target value, as stated earlier. This is followed by a step S80 for uniformly charging the entire periphery of the drum 1. Then, the D corona discharger 6 and PC corona discharger 7 are set in the same manner as the PT corona discharger 4 (S81, S82, S83 and S84). After the rotation of the drum 1 has been stopped (S85), the discharge lamp is turned off (S86) and the program returns to the main loop.

OUTPUT ERROR PROCESSING

In the illustrative embodiment, the output error processing is made up of two different stages of processing: OUTPUT ERROR PROCESSING:1 shown in FIG. 12 (S27) and OUTPUT ERROR PROCESSING:2 shown in FIG. 3 (S7). Recovery processing is executed in matching relation to the output error processing stage. An arrangement is so made as to allow the copier to be used even when the recovery processing is under way, thereby reducing the down time of the copier.

Figure 21:
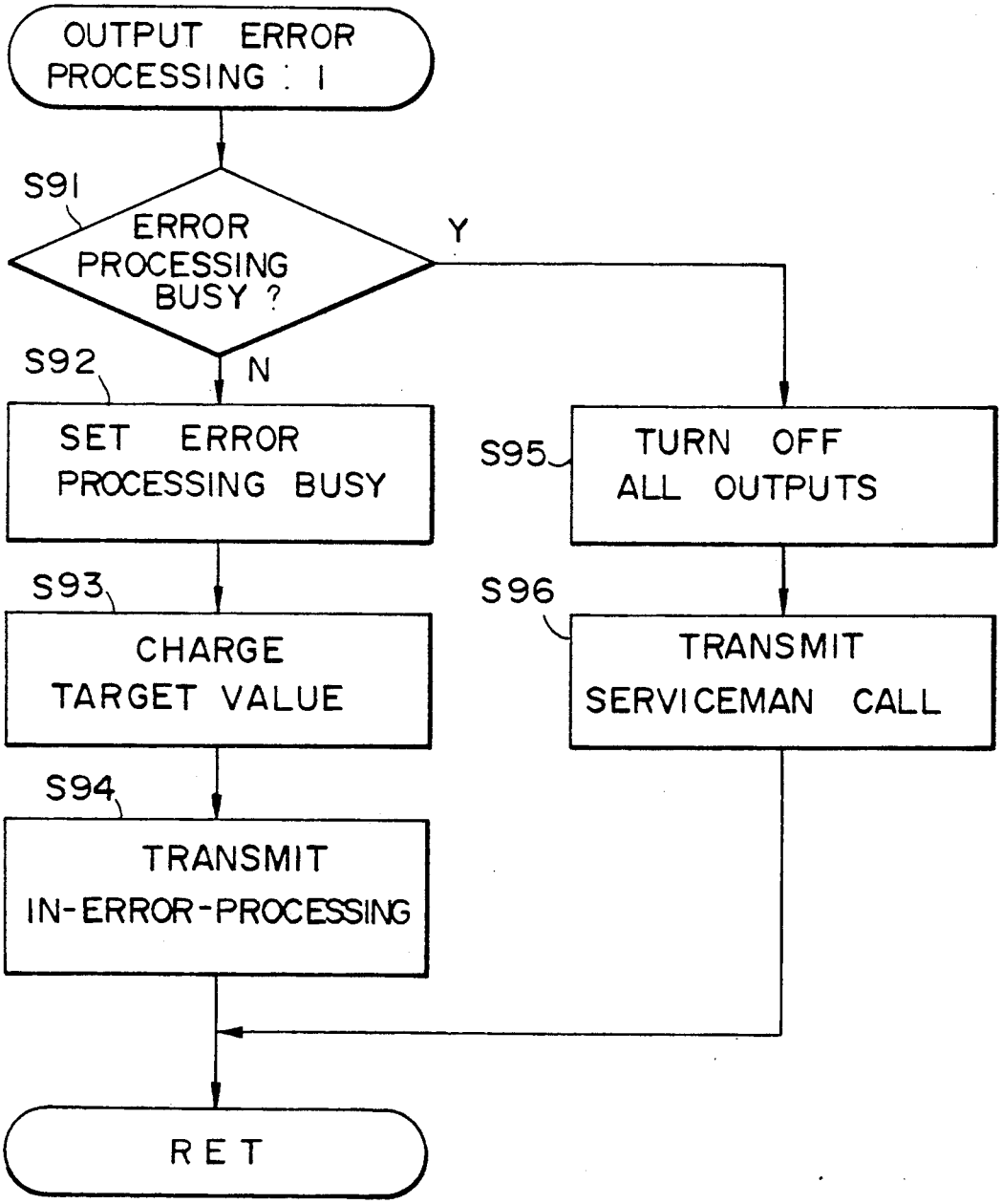
FIG. 21 is a flowchart showing an OUTPUT ERROR PROCESSING:1 subroutine.

In OUTPUT ERROR PROCESSING:, since a critical error of the load is anticipated, the OUTPUT VOLTAGE DETECT routine shown in FIG. 12 is interrupted to execute interrupt processing. Specifically, as shown in FIG. 21, whether or not an ERROR PROCESS BUSY signal indicative of ERROR PROCESS BUSY is appearing is determined (S91). If the answer of the step S91 is NO, ERROR PROCESS BUSY is set (S92), the target value is changed (S93), a signal is fed to the copier body control unit 105 to show that error processing is under way (S94), and the program returns to the main flow. If the answer of the step S91 is YES, all the outputs are turned off (S95), a serviceman call is transmitted to the copier body control unit 105 (S96), and the program returns to the main flow. In this manner, while recovery processing is executed when an error is detected for the first time, a serviceman call is transmitted to the copier body control unit 105 for inhibiting the use of the copier when an error is detected twice.

Figure 22:
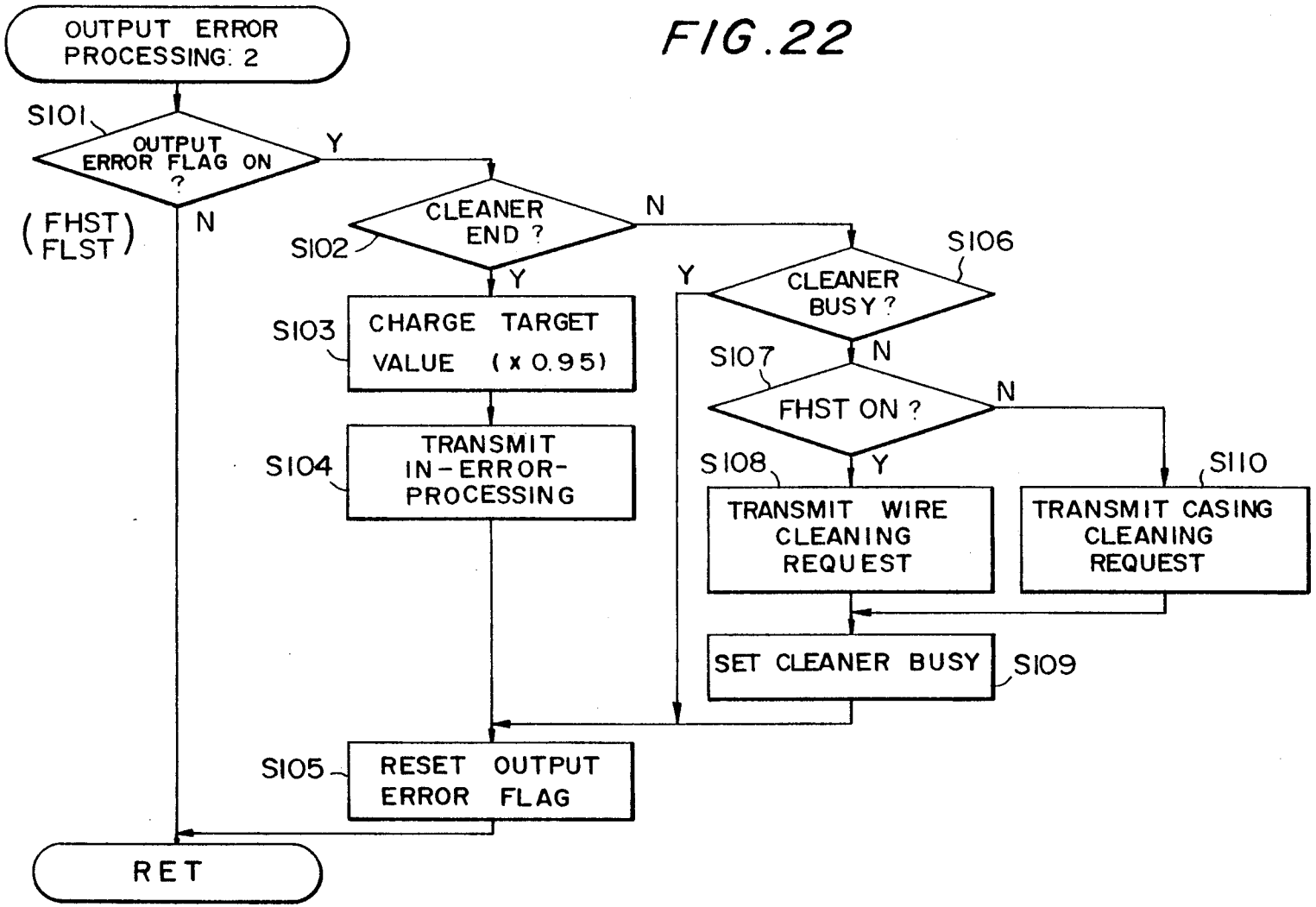
FIG. 22 is a flowchart showing an OUTPUT ERROR PROCESSING:2 subroutine.

OUTPUT ERROR PROCESSING:2 is available for removing an error ascribable to the contamination of the corona discharger A and is executed when the flag FHST or FLST is set. Specifically, as shown in FIG. 22, whether or not the output error flags have been set is determined (S101). If the answer of the step S101 is NO, the program returns to the main flow while, it is is YES, whether or not a cleaner end flag has been set, i.e., whether or not cleaning has been ended is determined (S102). If the answer of the step S102 is YES, the target value of the constant current of the high-tension output is changed (S103), a signal representative of error processing is transmitted to the copier body control unit 105 (S104), the output error flag is reset (S105), and the program returns to the main flow. If the answer of the step S102 is NO, whether or not CLEANER BUSY is set up is determined (S106). If the answer of the step S106 is YES, the program advances to a step S105 while, if it is NO, whether or not the flag FHST shown in the step S23 of FIG. 12 is set is determined (S107). If the answer of the step S107 is YES, a wire cleaning request is sent to the copier control unit 105 (S108), CLEANER BUSY is set (S109), an the step S105 is executed. If the answer of the step S107 is NO, a casing cleaning request is sent to the copier cody control unit 105 (S110) and the step 109 and successive steps are executed.

As stated above, when this processing is executed for the first time, which of the output error flags has been set is determined. A wire cleaning request and a casing cleaning request are sent to the copier body control unit 105 when FHST has been set and when FLST has been set, respectively, so as to set CLEANER BUSY. When cleaning is completed as urged by the request, the copier body control unit 105 transmits signals for setting a cleaner end flag and resetting CLEANER BUSY. When the output error flag is set despite the cleaner end flag being set again, the target value of the constant current of the high-tension output is changed. In this case, a signal is sent to the copier body control unit 105 to inform the latter of the fact that error processing is under way. In response, the control unit 105 shows the operator that error processing is under way and that repair is needed, while permitting the use of the copier.

In summary, it will be seen that the present invention provides a control arrangement for an image forming apparatus which frees a drum charge current from fluctuation and thereby insures desirable image forming conditions over a long period of time.

Various modifications will become possible for those skilled in the art after receiving the teachings of the present disclosure without departing from the scope thereof.

What is claimed is:

1. Control circuitry for an image forming apparatus, comprising:

high voltage generating means for applying a high voltage to a corona discharger which is located so as to face a photoconductive element which is installed in the image forming apparatus;

output current control means for controlling an output current of said of high voltage generator means to a constant value;

charge current detecting means connected to said output current control means and having a resistor for detecting a charge current of photoconductive element, said photoconductive element being connected to ground via said resistor;

a first half-wave rectifying means connected to said output current control means and connected in parallel with said resistor and assigned to a positive output for detecting a positive component of said charge current;

a second half-wave rectifying means connected to said output current control means and connected in parallel with said resistor and assigned to a negative output for detecting a negative component of said charge current; and voltage doubler rectifying means connected to said output current control means and connected in parallel with said resistor and assigned to a positive output for detecting an AC component of said charge current.

2. Control circuitry for an image in forming apparatus, comprising:

charge current detecting means for detecting a charge current of a photoconductive element;

a corona discharger located so as to face said photoconductive element;

high voltage generating means for applying a high voltage to said corona discharger;

output current control means for controlling an output current of said high voltage generating means;

first comparing means for comparing an output signal of said charge current detecting means with a predetermined reference value;

means responsive to a result of the comparison from said first comparing means for causing said output current control means to control said output current such that said output of said charge current detecting means becomes equal to said reference value;

means for controlling said output current to a constant current;

output voltage detecting means for detecting an output voltage of said high voltage generating means; and second comparing means for comparing said output voltage and a predetermined reference value;

said corona discharger being cleaned by a cleaning means when said second comparing means determines that said output current voltage is not equal to said reference value.

3. Circuitry as claimed in claim 2, wherein said output current control means varies said output current by a predetermined value in response to the result of said comparison.

4. Circuitry as claimed in claim 3, wherein said output current control means executes control a plurality of consecutive times until said output signal of said charge current detecting means becomes equal to said reference value.

5. Circuitry as claimed in claim 2, wherein said output current control means varies said output current by a value associated with the result of comparison to equalized said output signal and said predetermined value.

6. Circuitry as claimed in claim 2, wherein when said second comparing means again determines that said output voltage of said corona discharger having been cleaned is not equal to said reference value, a predetermined reference value of said output signal of said charge current detecting means is varied with an arrow being indicated.

7. Control circuitry for an image forming apparatus, comprising:

charge current detecting means, which allows for the simultaneous detection of AC and DC currents for detecting a charge current of a photoconductive element;

a corona discharger located so as to face said photoconductive element;

high voltage generating means for applying a high voltage to said corona discharger;

output current control means for controlling an output current of said high voltage generator means to a constant value;

first comparing means for comparing an output signal of said charge current detecting means with a predetermined reference value;

means responsive to a result of the comparison from said comparing means for causing said output current control means to control said output current such that said output of said charge current detecting means becomes equal to said reference value;

output voltage detecting means for detecting means for detecting an output voltage of said high voltage generating means; and second comparing means for comparing said output voltage and a predetermined reference value;

said corona discharger being cleaned by a cleaning means when said second comparing means determines that said output voltage is not equal to said reference value.

8. Circuitry as claimed in claim 7, wherein when said comparing means again determines that said output voltage of said corona discharger having been cleaned is not equal to said reference value, a predetermined reference value of said output signal of said charge current detecting means is varied with an arrow being indicated.

* * * * *